US011411330B2

(12) United States Patent
Nagayama et al.

(10) Patent No.: US 11,411,330 B2
(45) Date of Patent: Aug. 9, 2022

(54) CONNECTOR

(71) Applicant: Yazaki Corporation, Tokyo (JP)

(72) Inventors: Masataka Nagayama, Makinohara (JP); Kiyotaka Mizuno, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/988,857

(22) Filed: Aug. 10, 2020

(65) Prior Publication Data

US 2021/0057834 A1 Feb. 25, 2021

(30) Foreign Application Priority Data

Aug. 23, 2019 (JP) ..... JP2019-153133

(51) Int. Cl.
*H01R 9/24* (2006.01)
*H01R 9/18* (2006.01)
*H01R 13/436* (2006.01)

(52) U.S. Cl.
CPC ..... *H01R 9/24* (2013.01); *H01R 9/18* (2013.01); *H01R 13/4362* (2013.01); *H01R 2201/26* (2013.01)

(58) Field of Classification Search
CPC ... H01R 4/30; H01R 4/34; H01R 9/24; H01R 9/18; H01R 9/2416; H01R 13/42; H01R 13/52; H01R 13/405; H01R 13/4362; H01R 13/632; H01R 2201/26
USPC .... 439/166, 357, 519, 733.1, 737, 660, 813, 439/823
See application file for complete search history.

(56) References Cited

U.S. PATENT DOCUMENTS 5,947,774 A * 9/1999 Abe ..... H01R 13/514 439/701
2007/0207652 A1* 9/2007 Tsuruta ..... H01R 4/30 439/166
2010/0273362 A1* 10/2010 Matsuoka ..... H01R 9/18 439/737
2011/0147175 A1* 6/2011 Erickson ..... H01H 71/0264 200/51.09
2012/0238150 A1* 9/2012 Sakamoto ..... B29C 45/33 439/660

(Continued)

FOREIGN PATENT DOCUMENTS

JP 10-92479 A * 4/1998 ..... H01R 4/24
JP 10-92479 A 4/1998

(Continued)

*Primary Examiner* — William H. Mayo, III
(74) *Attorney, Agent, or Firm* — Sughrue Mion, PLLC

(57) ABSTRACT

A connector includes: a number of busbars; a housing holding of the busbars; and a cover mounted on the housing. The busbars each have a fastening target portion to connect a terminal metal fitting by using a bolt. The fastening target portion is housed in a housing room, and a number of the housing rooms is defined between the housing and the cover. One of the housing rooms corresponding to the fastening target portion of one of the busbars and another of the housing rooms corresponding to the fastening target portion of another of the busbars are separated with a partition wall, and at least part of the partition wall has a liquid-tight portion formed by engaging a projection of one of the housing and the cover with a recess of the other of the housing and the cover.

4 Claims, 7 Drawing Sheets

(56) References Cited

U.S. PATENT DOCUMENTS

| | | | | |
|---|---|---|---|---|
| 2013/0322049 | A1* | 12/2013 | Ishikawa | H01R 13/502 361/823 |
| 2014/0011408 | A1* | 1/2014 | Nakayama | H01R 13/405 439/733.1 |
| 2014/0370737 | A1* | 12/2014 | Okayasu | H01R 13/424 439/357 |
| 2015/0079855 | A1* | 3/2015 | Takemura | F16B 41/002 439/813 |
| 2017/0006703 | A1* | 1/2017 | Haraguchi | H05K 1/0203 |
| 2017/0305370 | A1* | 10/2017 | Yamashita | H02G 3/083 |
| 2018/0076533 | A1* | 3/2018 | Diop | H01R 4/12 |
| 2018/0083375 | A1* | 3/2018 | Matsumura | H01R 9/226 |
| 2018/0269624 | A1* | 9/2018 | Iwabe | H01R 13/631 |

FOREIGN PATENT DOCUMENTS

| | | | | | |
|---|---|---|---|---|---|
| JP | 2004-328932 | A | * | 11/2004 | H01R 9/00 |
| JP | 2004-328932 | A | | 11/2004 | |
| JP | 2008-17693 | A | | 1/2008 | |
| JP | 2018152265 | A | | 9/2018 | |

* cited by examiner

CONNECTOR

CROSS-REFERENCE TO RELATED APPLICATIONS

This application is based on and claims priority under 35 USC 119 from Japanese Patent Application No. 2019-153133 filed on Aug. 23, 2019, the contents of which are incorporated herein by reference.

TECHNICAL FIELD

The present disclosure relates to a connector which is equipped with plural busbars, a housing that houses the plural busbars, and a cover that is attached to the housing.

BACKGROUND ART

A connector is known which is equipped with a housing having plural terminal housing rooms and a cover that is attached to the housing so as to cover the terminal housing rooms and electric wires that extend from the terminal housing rooms. In this conventional connector, the cover mainly functions as a guide member for guiding the electric wires so that they extend from the housing in desired directions.

As for details of the above connector, refer to JP 2018-152265 A.

SUMMARY OF INVENTION in the connector of the above kind, in general, unintended short-circuiting or the like is prevented in such a manner that each tubular (box-shaped) terminal metal fitting that is crimped on a terminal portion of an electric wire is inserted into a terminal housing room and housed there and the plural terminal housing rooms are isolated from each other by partition walls.

On the other hand, in contrast to the above conventional connector, in the case where each terminal metal fitting is connected to a busbar that is fixed to a housing by, for example, insert molding by bolt fastening, it is necessary to secure setting spaces for bolts themselves and working spaces for performing fastening work. It is therefore difficult to form partition-wall-separated terminal housing rooms as employed in the above conventional connector. However, even in the connector of the type that each terminal metal fitting is fastened to a busbar using a bolt, it is desirable that busbars be isolated electrically from each other as in the above conventional connector.

Aspect of non-limiting embodiments of the present disclosure relates to provide a connector capable of preventing unintended short-circuiting between busbars even in the case where the connector has a structure that each terminal metal fitting is fastened to a busbar using a bolt.

According to an aspect of the present disclosure, there is provided a connector comprising:

a plurality of busbars;

a housing holding the plurality of the busbars; and a cover mounted on the housing, the plurality of the busbars each having a fastening target portion to connect a terminal metal fitting by using a bolt, the fastening target portion being housed in a housing room, and a plurality of the housing rooms being defined between the housing and the cover, one of the plurality of the housing rooms corresponding to the fastening target portion of one of the plurality of the busbars and another of the plurality of the housing rooms corresponding to the fastening target portion of another of the plurality of the busbars being separated with a partition wall, and at least part of the partition wall having a liquid-tight portion formed by engaging a projection of one of the housing and the cover with a recess of other of the housing and the cover.

BRIEF DESCRIPTION OF DRAWINGS

Exemplary embodiment(s) of the present invention will be described in detail based on the following figures, wherein.

DESCRIPTION OF EMBODIMENTS

Pre-connectorized electric wires 1 having a connector 6 according to an exemplary embodiment of the present invention will be hereinafter described with reference to the drawings. Typically, the pre-connectorized electric wires 1 are used being attached to, for example, a housing of a transmission that is part of a drive system of a vehicle. In other words, the pre-connectorized electric wires 1 are a member that is part of a vehicular wire harness.

In the following description, for convenience of description, terms "front-rear direction," "left-right direction," "top-bottom direction," "front," "rear," "left," "right," "top," and "bottom" are defined as shown in figures. The front-rear direction, the left-right direction, and the top-bottom direction are perpendicular to each other. The front-rear direction coincides with a direction in which a housing 4 is fitted with a counterpart connector (not shown). The side on which the housing 4 is fitted with the counterpart connector, that is, a fitting direction front side (top-right side in FIG. 2), is defined as the front side and the side opposite to the fitting direction front side, that is, a fitting direction back side (bottom-left side in FIG. 2), is defined as the rear side.

Figure 1:
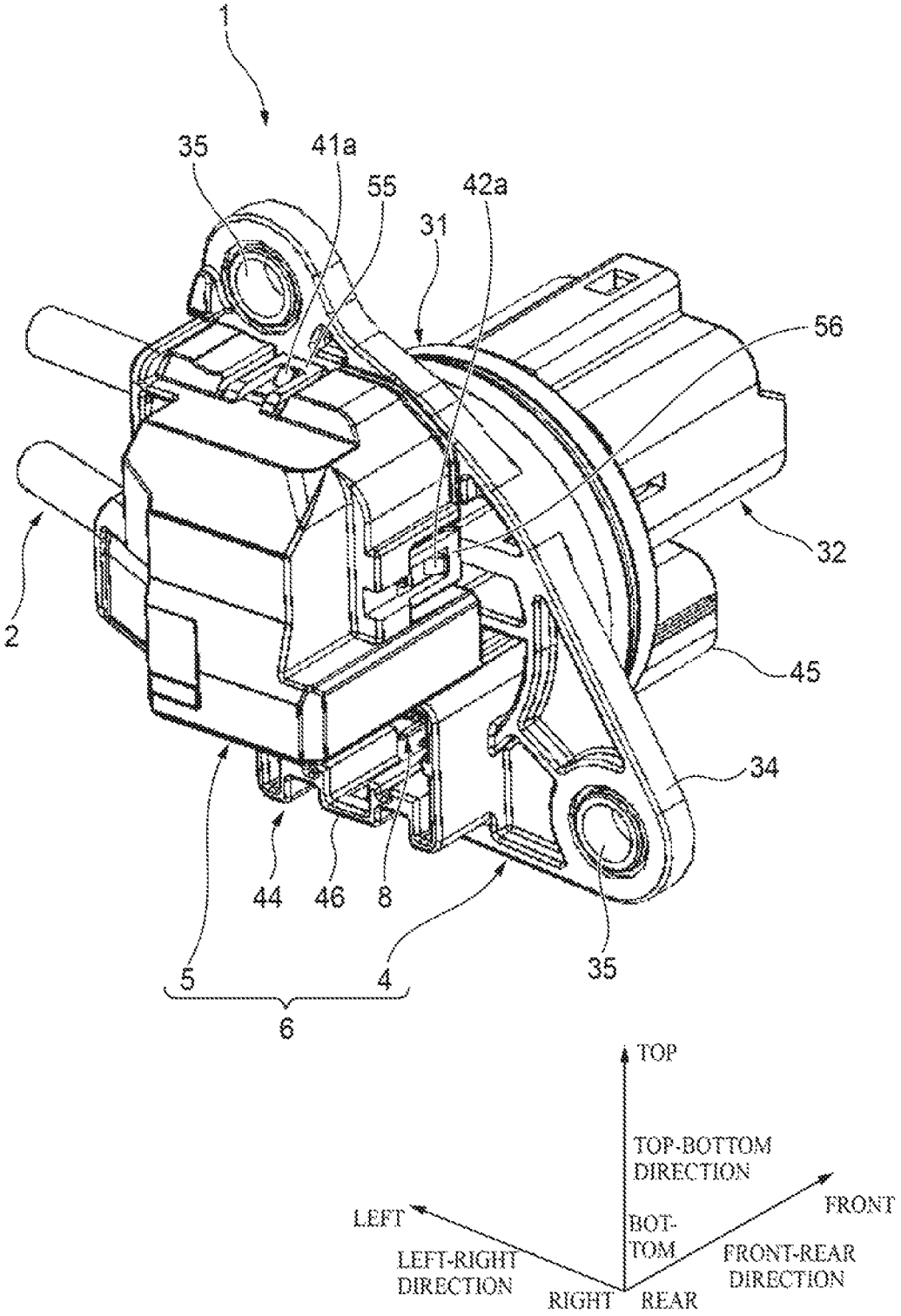
FIG. 1 is a perspective view of pre-connectorized electric wires having connectors according to an exemplary embodiment of the present invention.
Figure 2:
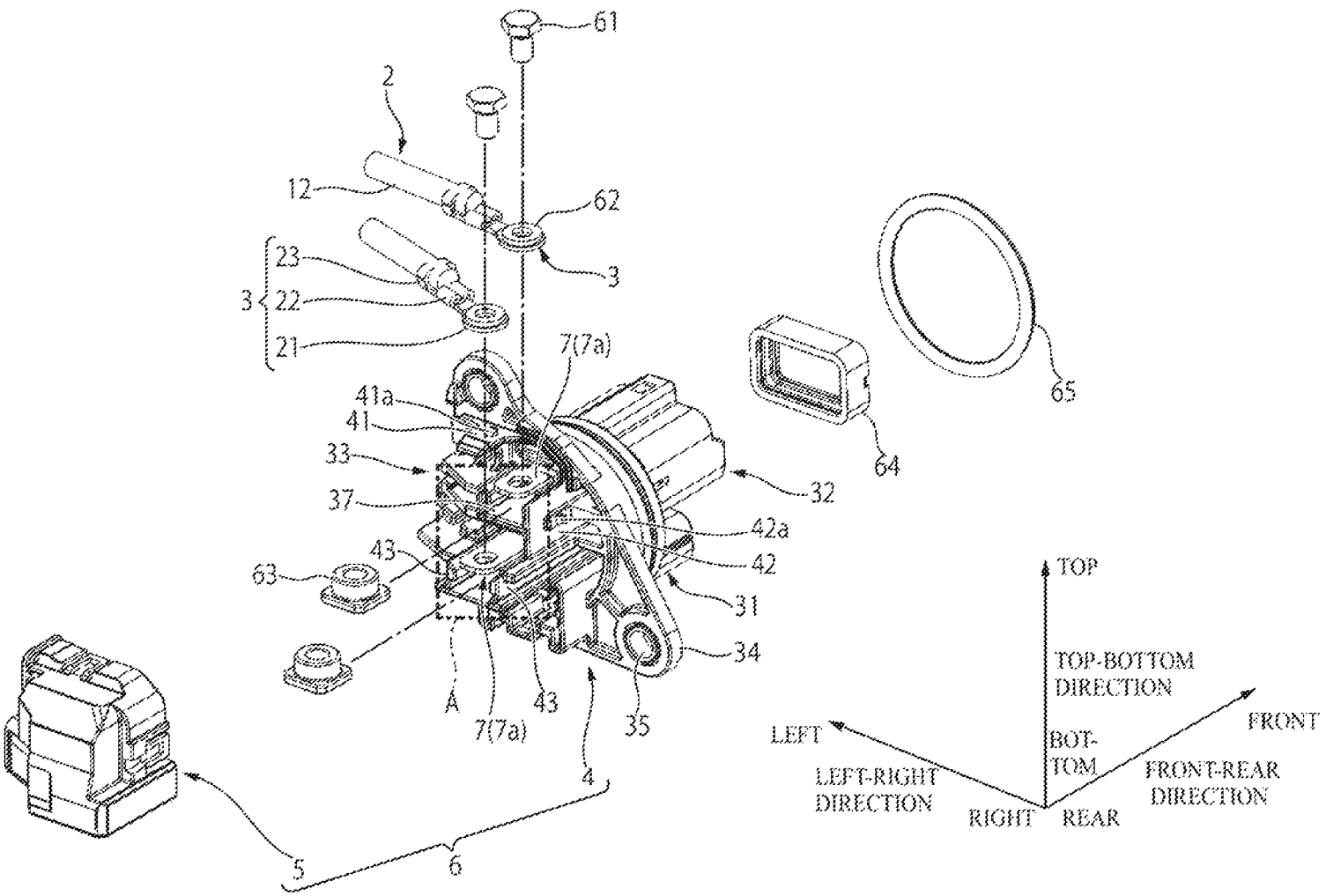
FIG. 2 is an exploded perspective view of the pre-connectorized electric wires.

As shown in FIG. 2, the pre-connectorized electric wires 1 shown in FIG. 1 are equipped with electric wires 2, terminal metal fittings 3 which are attached to the respective electric wires 2, the housing 4 to which the terminal metal fittings are fastened, and a cover 5 which is attached to the housing 4. The housing 4 and the cover 5 constitute a connector 6 according to the embodiment of the invention. Components of the pre-connectorized electric wires 1 will be described below in order.

Figure 4A:
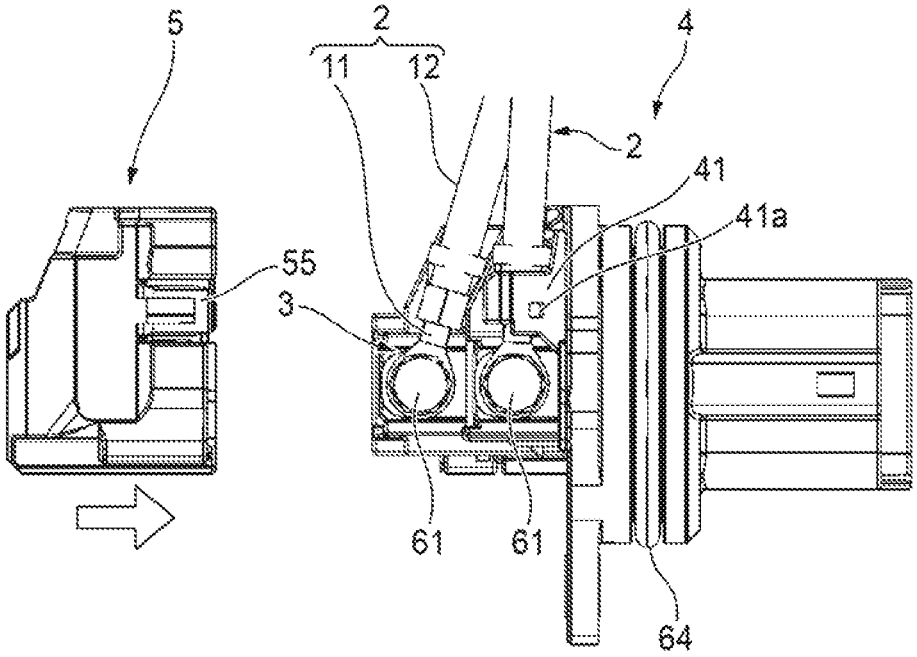
FIG. 4A is a top view showing how a cover is attached to a housing and FIG. 4B is a top view showing a state that the attachment of the cover to the housing is completed.
Figure 4B:
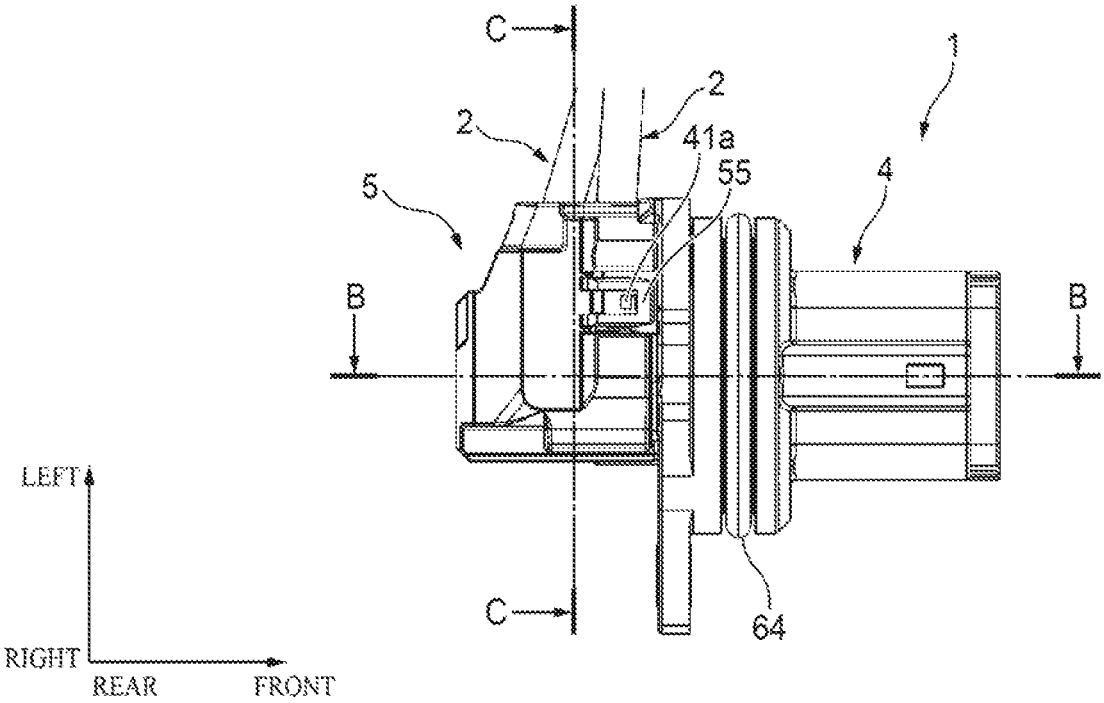

First, the electric wires 2 will be described. As shown in FIG. 2 and FIG. 4A, each of the electric wires 2 is composed of a conductor core wire 11 and a resin covering 12 which covers the conductor core wire 11. A terminal portion of each electric wire 2 was subjected to a prescribed terminal treatment, whereby a portion of the resin covering 12 is removed and a portion of the conductor core wire 11 is exposed there. Typically, one of the electric wires 2 is grounded.

Next, the terminal metal fittings 3 will be described. As shown in FIG. 2, each of the terminal metal fittings 3 (made of a metal) has, in a unitized manner, a terminal portion 21 which is shaped like a circular plate and through which a bolt hole is formed, a core wire crimping portion 22 which adjoins the terminal portion 21 and is crimped on an exposed portion of the electric wire 2, and a covering crimping portion 23 which adjoins the core wire crimping portion 22 and is crimped on a tip portion of the resin covering 12 of the electric wire 2. The terminal portion 21 is to be fastened to a fastening target portion 7*a* of a busbar 7 (described later).

Next, the housing 4 will be described. As shown in FIG. 2, the resin housing 4 has, in a unitized manner, a main body 31, a connector fitting portion 32 which is located in front of the main body 31, and a cover attaching portion 33 which is located in the rear of the main body 31. Plural (in this example, two) busbars 7 (metal plates) which extend in the front-rear direction are provided inside the main body 31 so as to be integrated with the main body 31 by insert molding.

As shown in FIG. 1 and FIG. 2, the main body 31 has a cylinder portion and flange portions 34 which are connected to a rear end portion of the cylinder portion, have a prescribed shape, and project outward in radial directions of the cylinder portion. Plural bolt holes 35 penetrate through the respective flange portions 34 in the front-rear direction.

Typically, the main body 31 is fixed to a housing of a transmission of a vehicle by inserting the cylinder portion of the main body 31 into a circular opening (not shown) of the housing and fastening the flange portions 34 to the housing using bolts (not shown) inserted in the bolt holes 35, respectively. In a state that the main body 31 is fixed to the housing, the connector fitting portion 32 (and a counterpart connector to be fitted with the connector fitting portion 32) is located in the air and the cover attaching portion 33 (and the cover 5 to be attached to the cover attaching portion 33) is located in lubricant of the transmission.

Figure 6A:
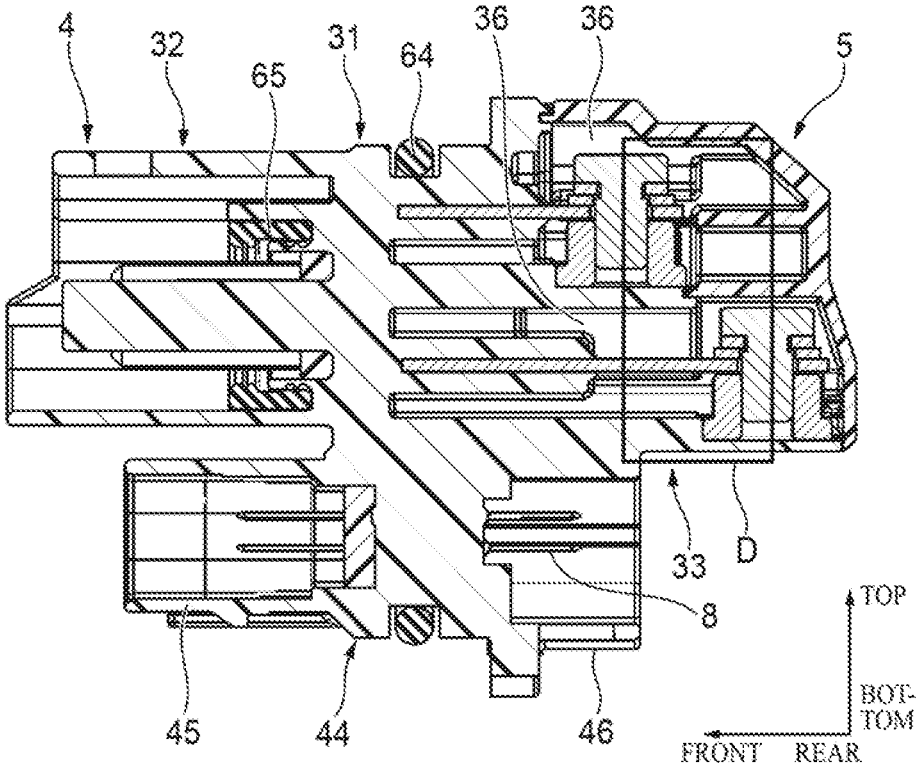
FIG. 6A is a B-B sectional view of FIG. 4B

As shown in FIG. 1 and FIG. 2, and FIG. 6A, the connector fitting portion 32 has a rectangular hood shape that is open at the front end. The counterpart connector is to be inserted into and fitted in the connector fitting portion 32. As a result, counterpart terminals (not shown) housed in the counterpart connector are electrically connected to portions (not shown). exposed in the internal space of the connector fitting portion 32, of the respective busbars 7, whereby counterpart electric wires (not shown) connected to the respective counterpart terminals are electrically connected to the respective busbars 7 incorporated in the housing 4.

Figure 3:
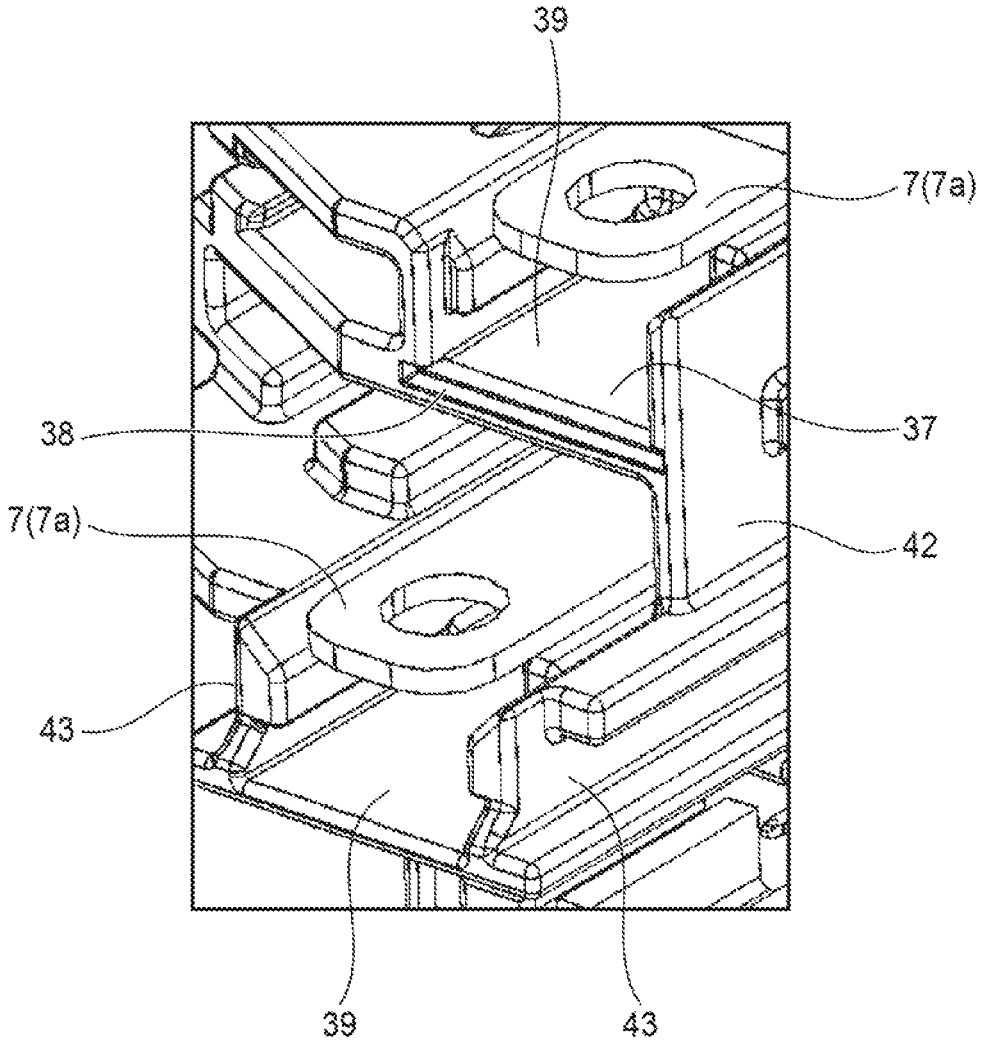
FIG. 3 is an enlarged view of part A of FIG. 2.

The cover attaching portion 33 is a portion to which the terminal metal fittings 3 are fastened as well as a portion to which the cover 5 is attached. In the cover attaching portion 33, as shown in FIG. 2 and FIG. 3, fastening target portions 7*a* as rear portions of the two busbars 7 are exposed so as to project rearward from the main body 31 and spaced from each other in the top-bottom direction by a prescribed interval. Bolt holes are formed through the respective fastening target portions 7*a*. As seen from FIG. 2 to FIGS. 4A and 4B, the fastening target portion 7*a* of the lower busbar 7 projects rearward more than that of the upper busbar 7. In other words, when viewed in the top-bottom direction, the bolt holes of the two fastening target portions 7*a* are offset from each other in the front-rear direction.

Figure 6B:
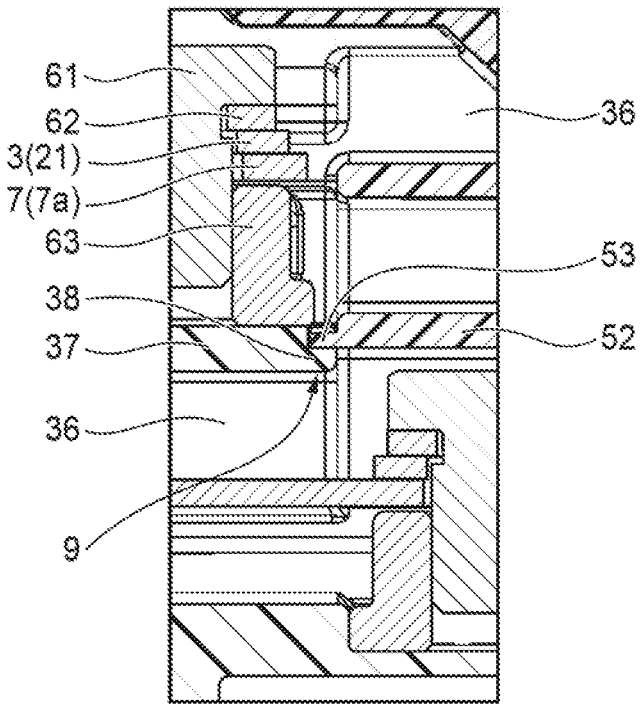
FIG. 6B is an enlarged view of part D of FIG. 6A.
Figure 7:
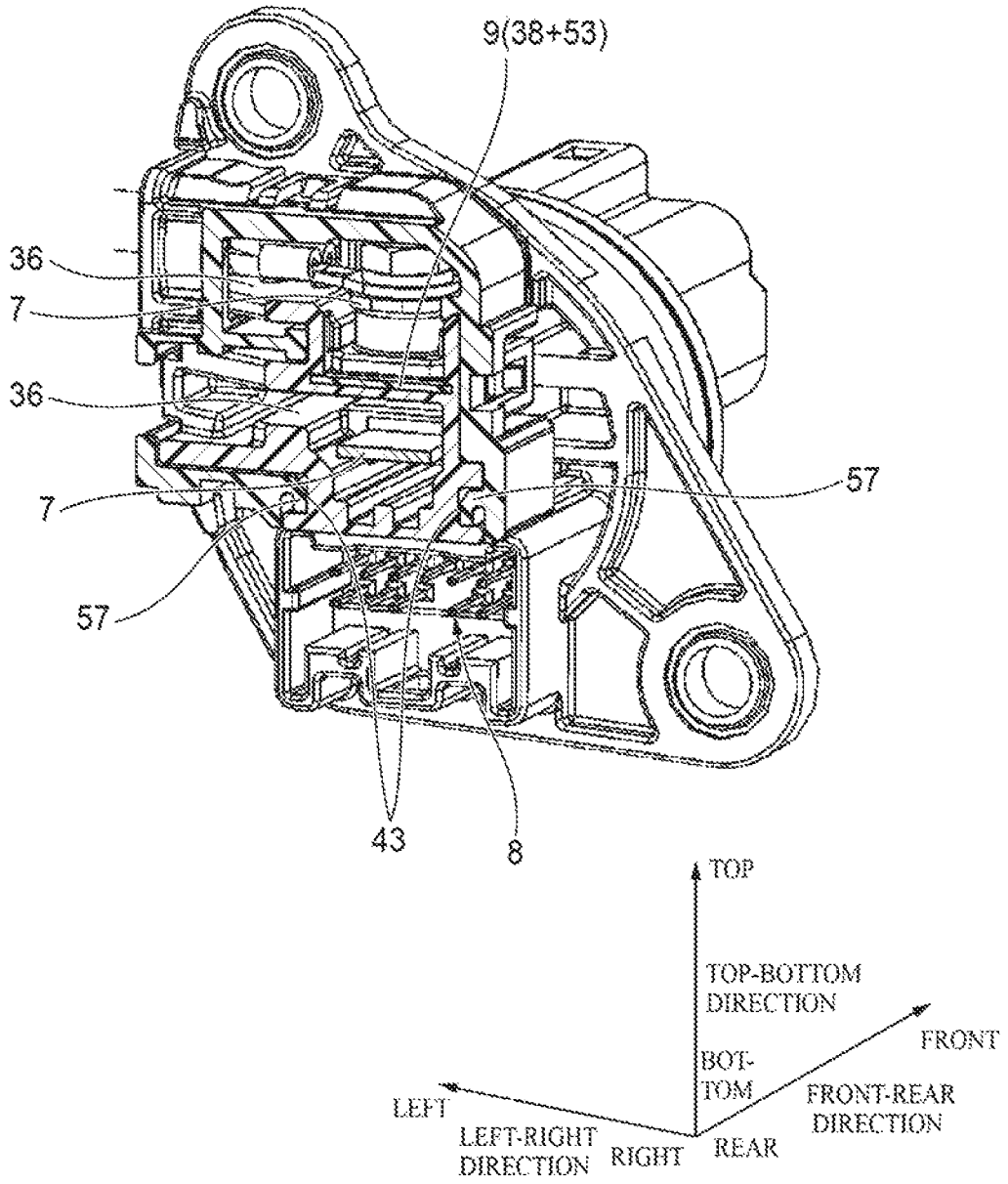
FIG. 7 is a C-C sectional view of FIG. 4B.

As shown in FIGS. 6A and 6B and FIG. 7, the cover attaching portion 33 in such a manner that the cover 5 is attached to the cover attaching portion 33, has such a shape as to define two housing rooms 36 for housing the two respective fastening target portions 7*a* together with the cover 5 so that the two housing rooms 36 are arranged in the top-bottom direction. As shown in FIG. 2 and FIG. 3, the cover attaching portion 33 has, as part of a partition wall that separates, in the top-bottom direction, the two housing rooms 36 that are formed by the cover attaching portion 33 and the cover 5, a partition wall 37 which is located between the top fastening target portion 7*a* and the bottom fastening target portion 7*a*. The partition wall 37 is shaped like a flat plate that extends in the left-right direction and rearward.

As shown in FIG. 3, the rear end surface of the partition wall 37 is formed with a recess 38 which has an opening at the rear end, is recessed forward, and extends in the left-right direction. The recess 38 is to engage with a projection 53 (see FIG. 5) of the cover 5.

As shown in FIG. 3, the cover attaching portion 33 is shaped in such a manner that nut setting portions 39 are defined under the respective fastening target portions 7*a*. Each nut setting portion 39, which is a space in which to set a nut 63 (see FIG. 2) to be used in fastening the terminal portion 21 of a terminal metal fitting 3 to the corresponding fastening target portion 7*a*, is open rearward and adjoins the bottom surface of the corresponding fastening target portion 7*a*. The partition wall 37 of the cover attaching portion 33 also serves as a wall for defining the bottom end of the top one of the two nut setting portions 39.

As shown in FIG. 2, the cover attaching portion 33 is formed with a flat-plate-shaped guide piece 41 which is located above the top fastening target portion 7*a* and projects rearward from the main body 31 so as to extend in the left-right direction. The top surface of the guide piece 41 is formed with a lock projection 41*a* which projects upward. A flat-plate-shaped guide piece 42 is formed on the right of the pair of (top and bottom) fastening target portion 7*a* so as to project rearward from the main body 31 and extend in the top-bottom direction. The right surface of the guide piece 42 is formed with a lock projection 42*a* which projects rightward.

Furthermore, the left and right outside surfaces of a pair of (left and right) side walls that define the left and right ends of the bottom nut setting portion 39 are formed with a pair of guide grooves 43 that are recessed inward in the left-right direction and extend in the front-rear direction, respectively. The guide pieces 41 and 42 and the guide grooves 43 exercise functions of guiding the cover 5 when it is attached to the cover attaching portion 33 and fixing the cover 5 to the cover attaching portion 33.

As shown in FIG. 1 and FIG. 6B, a second connector fitting portion 44 is provided as a lower portion of the main body 31 of the housing 4 (below the connector fitting portion 32 and the cover attaching portion 33). Plural pin terminals 8 which extend in the front-rear direction are provided inside the second connector fitting portion 44 so as to be integrated with the second connector fitting portion 44 by insert molding. A rectangular-hood-shaped first hood portion 45 having an opening at the front end is formed in front of the second connector fitting portion 44, and a rectangular-hood-shaped second hood portion 46 having an opening at the rear end is formed in the rear of the second connector fitting portion 44.

Front end portions of the pin terminals 8 are exposed in the internal space of the first hood portion 45 and rear end portions of the pin terminals 8 are exposed in the internal space of the second hood portion 46. A second counterpart connector (not shown) and a third counterpart connector (not shown) are to be inserted into and fitted in the first hood portion 45 and the second hood portion 46, respectively. As a result, second counterpart terminals (not shown) housed in the second counterpart connector are electrically connected to third counterpart terminals (not shown) housed in the third counterpart connector via the pin terminals 8, respectively.

Figure 5:
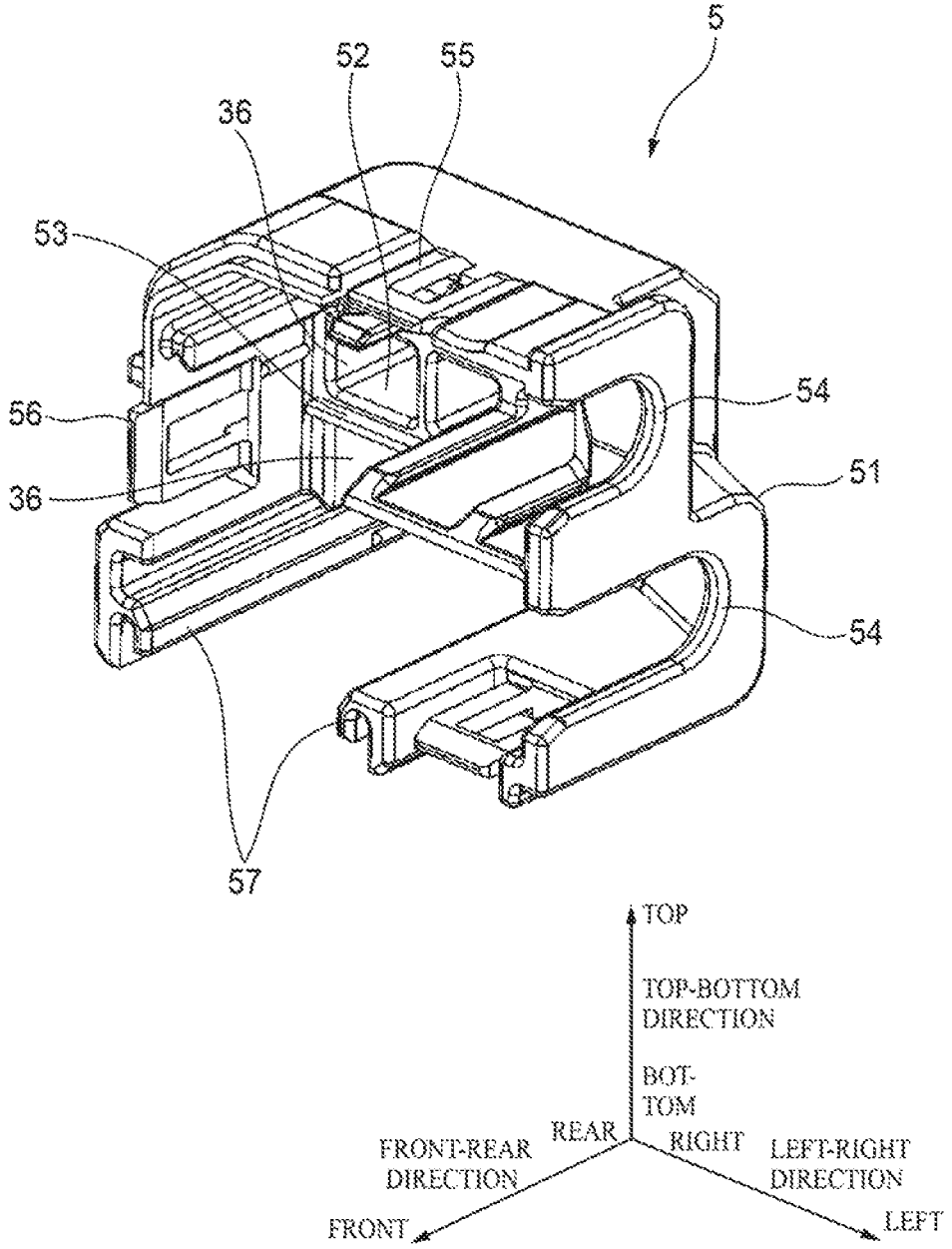
FIG. 5 is a perspective view of the cover.

Next, the cover 5 will be described. As shown in FIG. 5, the resin cover 5 has an approximately cuboid-shaped (i.e., box-shaped) body 51 having openings at the front end and at the bottom. A flat-plate-shaped partition wall 52 which projects from a rear wall of the body 51 so as to extend in the left-right direction and forward is formed in the internal space of the body 51. A projection 53 projects forward from the front end surface of the partition wall 52 so as to extend in the left-right direction.

The partition wall 52 is provided at a position corresponding to the partition wall 37 (see FIG. 3) of the housing 4 and functions, like the partition wall 37, as part of the partition wall that separates the two housing rooms 36 in the top-bottom direction in a state that the cover 5 is attached to the housing 4. Thus, in the internal space of the body 51, the region over the partition wall 52 constitutes part of the housing room 36 that houses the top fastening target portion 7*a* and the region under the partition wall 52 constitutes part of the housing room 36 that houses the bottom fastening target portion 7*a*.

The left wall of the body 51 is formed with a pair of (i.e., top and bottom) wire lead-out portions 54 that have openings at the front ends, are recessed rearward, and communicate with the pair of (i.e., upper and lower) housing rooms 36 in the left-right direction, respectively. Each wire lead-out portion 54 functions as an opening for leading out an electric wire 2 connected to the terminal metal fitting 3 housed in the associated housing room 36 to the outside (i.e., leftward).

Part of the top wall of the body 51 is formed with a tongue-shaped lock piece 55 which extends forward like a cantilever so as to correspond to the guide piece 41 of the housing 4. Part of the right wall of the body SI is formed with a tongue-shaped lock piece 56 which extends forward like a cantilever so as to correspond to the guide piece 42 of the housing 4. The bottom end portion of the body 51 is formed with a pair of guide ribs 57 which extend in the front-rear direction, so as to correspond to the pair of guide grooves 43 of the housing 4, respectively. The components of the pre-connectorized electric wires 1 have been described above in order.

Next, an assembling procedure of the pre-connectorized electric wires 1 will be described. First, as shown in FIG. 6A, a rectangular-frame-shaped packing 64 made of rubber (see FIG. 2) is set in the internal space of the connector fitting portion 32 of the housing 4 at a prescribed position and an O-ring 65 made of rubber (see FIG. 2) is attached to the outer circumferential surface of the cylinder portion of the main body 31 of the housing 4.

Then, as shown in FIG. 2 and FIG. 4A, the terminal metal fittings 3 to which the electric wires 2 are connected are fastened to the fastening target portions 7*a* of the pair of busbars 7 of the housing 4, respectively. To this end, first, nuts 63 are inserted into the respective nut setting portions 39 of the housing 4 from the rear side. As a result, the nuts 63 are set in the nut setting portions 39 so that they cannot rotate about their axes.

Then, the terminal portions 21 of the terminal metal fittings 3 to which the electric wires 2 are connected are put on the top surfaces of the fastening target portions 7*a* of the busbars 7 so that the terminal metal fittings 3 are directed to regular directions, respectively, and bolts 61 are inserted into the bolt holes of the terminal portions 21 and the fastening target portions 7*a* through washers 62 from above, respectively, and threadedly engaged with the nuts 63 which are placed under the fastening target portions 7*a*, respectively. As a result, each set of a fastening target portion 7*a* and a terminal portion 21 is sandwiched between the head of the associated bolt 61 and the associated nut 63 and the terminal metal fitting 3 is fastened to the associated fastening target portion 7*a* so as to be directed to the regular direction.

In this state, since the two fastening target portions 7*a* are arranged so as to be offset in the front-rear direction, in fastening the respective fastening target portions 7*a* using the bolts 61, one fastening target portion 7*a* that has been fastened using a bolt 61 does not likely obstruct the work of fastening the other fastening target portion 7*a* using a bolt 61. In the above-described manner, the electric wires 2 connected to the terminal metal fittings 3 are electrically connected to the respective busbars 7 which are housing in the housing 4.

The fastening direction (rotation direction) of each bolt 61 is clockwise (right-handed) when viewed from above. In a state that the terminal metal fittings 3 are directed to the regular directions, as shown in FIG. 4A the terminal metal fittings 3 extend leftward from the respective terminal portions 21 (fastening target portions 7*a*) and hence the electric wires 2 that are connected to the respective terminal metal fittings 3 also extend leftward.

Subsequently, the cover 5 is attached to the cover attaching portion 33 of the housing 4 so as to cover the connection portions of the terminal metal fittings 3. To this end, as shown in FIG. 4A, the cover 5 is brought closer to the cover attaching portion 33 from the rear side. Then the cover 5 is moved forward, that is, toward the cover attaching portion 33, so that the front surface of the partition wall 52 of the cover 5 comes closer to the rear surface of the partition wall 37 of the housing 4 in the front-rear direction with the former kept opposed to the latter and the pair of electric wires 2 go into the pair of wire lead-out portions 54, that the inner surface of the top wall of the body 51 of the cover 5 and inner surface of the right wall of the body 51 are guided by the respective guide pieces 41 and 42 of the cover attaching portion 33, and that the pair of guide ribs 57 of the body 51 slide being engaged with the pair of guide grooves 43 of the cover attaching portion 33, respectively.

The cover 5 continues to be moved forward until the cover 5 reaches such a position (attachment completion position (see FIG. 4B)) that the front end surface of the body 51 comes into contact with the rear end surface of the main body 31 (more specifically, flange portions 34) of the housing 4. When the cover 5 has moved to the attachment completion position, as shown in FIG. 1 the lock projections 41*a* and 42*a* of the guide pieces 41 and 42 are engaged with the lock pieces 55 and 56 of the cover 5, respectively. As a result, the cover 5 is held at the attachment completion position and is prevented from being separated from the housing 4.

Furthermore, a liquid-tight portion 9 is formed as a result of the engagement between the projection 53 of the partition wall 52 of the cover 5 and the recess 38 of the partition wall 37 of the housing 4 (see FIG. 6B and FIG. 7). More specifically, as shown in FIG. 6B, the recess 38 is formed in a tip portion of the partition wall 37 so as to have a step-like shape that the tip surface of the partition wall 37 is recessed forward in an area including the upper edge (the tip portion is made thinner). The projection 53 is formed in a tip portion of the partition wall 52 so as to have such a thickness and a projection length as to be able to go into the recess 38. The liquid-tight portion 9 is formed as a result of placement of the projection 53 into the recess 38 in a state that the lower surface of the projection 53 and the lower inner surface of the recess 38 face each other and the tip surface of the projection 53 and the bottom surface (facing the rear side) of the recess 38 face each other.

Having a labyrinthine structure that elongates the entrance path (what is called a creepage distance) of water going to pass between the partition walls 52 and 37, the above-configured liquid-tight portion 9 exercises a superior liquid-tightness providing function. The lower surface of the projection 53 and the lower inner surface of the recess 38 may be in close contact with each other, be opposed to each other with such a small gap that movement of oil or the like through the liquid-tight portion 9 can be suppressed, or be in close contact with each other in part of it and be opposed to each other with a small gap in the other part. The same is true of the positional relationship between the tip surface of the projection 53 and the bottom surface (facing the rear side) of the recess 38. That is, there are no particular limitations on the degree of contact between the recess 38 and the projection 53 as long as the liquid-tight portion 9 can exercise a desired liquid-tightness providing function.

The attachment of the cover 5 to the housing 4 is completed in the above-described manner, whereby the pre-connectorized electric wires 1 shown in FIG. 1 is obtained.

As shown in FIG. 6A, in the state that the attachment of the cover 5 to the housing 4 is completed, the lower bolt 61 is located right under the partition wall 52 of the cover 5. Thus, if it is attempted to attach the cover 5 to the housing 4 in a state that the lower bolt 61 is floated upward due to incomplete fastening, the cover 5 cannot be moved to the attachment completion position because the projection 53 of the partition wall 52 of the cover 5 interferes with the lower bolt 61. Thus, a state that the lower bolt 61 is floated upward due to incomplete fastening can be detected by detecting that the cover 5 cannot be moved to the attachment completion position.

In the state that the attachment of the cover 5 is completed, the electric wires 2 are led out through the respective wire lead-out portions 54 of the cover 5. Thus, even if someone tries to rotate, unintentionally, a fastened terminal metal fitting 3 in a loosening direction (counterclockwise when viewed from above), the rotation of the terminal metal fitting 3 can be suppressed because the electric wire 2 comes into contact with the rear end portion of the associated wire lead-out portion 54.

The pre-connectorized electric wires 1 shown in FIG. 1 is attached to a housing of a transmission of a vehicle and the counterpart connector is inserted and fitted into the connector fitting portion 32. As a result, as mentioned above, the counterpart terminals housed in the counterpart connector are electrically connected to the respective busbars 7 incorporated in the housing 4.

As a result, the counterpart electric wires that are connected to the counterpart terminals of the counterpart connector are electrically connected to the electric wires 2 that are connected to the terminal metal fittings 3 via the busbars 7 incorporated in the housing 4, respectively. One of the electric wires 2 is grounded to a prescribed grounding point of the vehicle. As a result, one of the counterpart electric wires that are electrically connected to the electric wires 2 is also grounded.

In a state that the pre-connectorized electric wires 1 is attached to the housing of the transmission of the vehicle, as described above the cover attaching portion 33 (i.e., cover 5) is located in lubricant of the transmission. Thus, the fastening target portions 7*a* of the busbars 7 which are located in the cover attaching portion 33 are also exposed to the lubricant. Since the cover 5 is attached to the housing 4, a phenomenon that metal powder existing in the lubricant comes into contact with the fastening target portions 7*a* can be suppressed.

As described above, in the connector 6 which is part of the pre-connectorized electric wires 1 according to the embodiment of the invention, the plural housing rooms 36 are formed between the housing 4 and the cover 5 when the cover 5 is attached to the housing 4. The fastening target portions 7*a* (where the busbars 7 are fastened by the bolts 61) of the respective busbars 7 are housed in the plural respective housing rooms 36. Furthermore, the partition wall (i.e., the partition wall 37 of the housing 4 and the partition wall 52 of the cover 5) located between the fastening target portion 7*a* of one busbar 7 and that of another busbar 7 and defining the associated housing rooms is provided with a liquid-tight portion 9 that is formed in such a manner that the projection 53 of the partition wall 52 and the recess 38 of the partition wall 37 engage with each other. Having a labyrinthine structure that elongates the entrance path (what is called a creepage distance) of water going to pass between the partition walls 37 and 52, the liquid-tight portion 9 exercises a superior liquid-tightness providing function. As such, the connector 6 according to the embodiment can prevent unintended short-circuiting between busbars 7 even in the case where the connector 6 has a structure that each terminal metal fitting 3 is fastened to a busbar 7 using a bolt.

In the connector 6 according to the embodiment, the fastening target portions 7*a* are arranged so as to be offset from each other when the fastening target portions 7*a* (i.e., parts of the busbars 7) are viewed along the fastening axes of the bolts 61 (in the top-bottom direction). Thus, when the fastening target portions 7*a* of the busbars 7 are fastened actually using the bolts 61, the bolt 61 inserted in one fastening target portion 7*a* does not likely obstruct the work of fastening another fastening target portion 7*a* using a bolt 61. As a result, in the connector 6 according to the embodiment, the efficiency of work of fastening the busbars 7 using the bolts 61 can be increased. This measure also contributes to miniaturization of the connector 6 because the intervals between the fastening target portions 7*a* along the fastening axes can be shortened.

In the connector 6 according to the embodiment, the efficiency of work of attaching the cover 5 to the housing 4 can be increased by the engagement between the guide portions (e.g., the pair of guide ribs 57) of the cover 5 and the reception portions (e.g., the pair of guide grooves 43) of the housing. Furthermore, unintended lowering of the liquid-tightness providing function can be prevented because the projection 53 of the cover 5 and the recess 38 of the housing 4 are engaged with each other properly by suppressing the positional deviation between them.

In the connector 6 according to the embodiment, the partition wall 37 of the housing 4 is provided with the nut setting portion 39 in which a nut 63 to engage with a bolt 61 with the fastening target portion 7*a* of a busbar 7 sandwiched between the nut 63 and the bolt 61 can be set. Enabling unification of the nut setting portion 39 and the partition wall 37, this measure allows the connector 6 to be made smaller than in a case that the nut setting portion 39 and the partition wall 37 are provided separately.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

In the above embodiment, the liquid-tight portion 9 is formed in such a manner that the recess 38 of the partition wall 37 of the housing 4 and the projection 53 of the partition wall 52 of the cover 5 engage with each other. Alternatively, a liquid-tight portion may be formed in such a manner that a projection of the partition wall 37 of the housing 4 and a recess of the partition wall 52 of the cover 5 engage with each other.

In the above embodiment, as described above with reference to FIG. 6B, the recess 38 has a step-like shape that the tip surface of the partition wall 37 is recessed in an area including the upper edge. As a result, when the liquid-tight portion 9 is formed by engagement between the recess 38 and the projection 53, the upper surface of the projection 53 is exposed instead of being covered with the recess 38 whereas the tip surface and the lower surface of the projection 53 are covered with the recess 38. Alternatively, to elongate the creepage distance further to attain further enhancement of the liquid-tightness of the liquid-tight portion 9, the recess 38 may be changed in shape (e.g., to a hole shape) so as to cover the upper surface of the projection 53 in addition to its tip surface and lower surface. A further alternative is possible in which plural recesses 38 and plural projections 53 are formed and engaged to form liquid-tight portions 9. That is, there are no particular limitations on the specific shapes of the recess 38 and the projection 53 as long as the liquid-tight portion 9 can exercise its desired liquid-tightness providing function.

In the above embodiment, the nut setting portion 39 and the partition wall 37 are integrated together. Alternatively, the nut setting portion 39 and the partition wall 37 may be provided separately.

According to the above exemplary embodiments, the connector (6) comprises:

a plurality of busbars (7);

a housing (4) holding the plurality of the busbars (7); and a cover (5) mounted on the housing (4).

the plurality of the busbars (7) each has a fastening target portion (7*a*) to connect a terminal metal fitting (3) by using a bolt (61).

the fastening target portion (7*a*) is housed in a housing room (36), and a plurality of the housing rooms (36) is defined between the housing (4) and the cover (5).

one of the plurality of the housing rooms (36) corresponding to the fastening target portion (7*a*) of one of the plurality of the busbars (7) and another of the plurality of the housing rooms (36) corresponding to the fastening target portion (7*a*) of another of the plurality of the busbars (7) are separated with a partition wall (37, 52), and at least part of the partition wall (37, 52) has a liquid-tight portion (9) formed by engaging a projection (53) of one of the housing (4) and the cover (5) with a recess (38) of other of the housing (4) and the cover (5).

In the connector having the above configuration, the plural housing rooms are formed between the housing and the cover when the cover is attached to the housing. The fastening target portions (where the busbars are fastened by the bolts) of the respective busbars are housed in the plural respective housing rooms. Furthermore, the partition wall located between the fastening target portion of one busbar and that of another busbar and defining the associated housing rooms is provided with a liquid-tight portion that is formed in such a manner that the projection of one of the housing and the cover and the recess of the other engage with each other. Having a structure (what is called a labyrinthine structure) that elongates the entrance path (what is called a creepage distance) of water, oil, or the like going to pass through the partition wall, the above-configured liquid-tight portion exercises a superior liquid-tightness providing function. As a result, the busbars can properly be insulated electrically from each other in a case that the connector is used in a common use environment of and even in a case that the connector is used in a severe environment (e.g., in lubricant of a transmission) in which the connector is exposed to water, oil, or the like. As such, the connector having the above configuration can prevent unintended short-circuiting between busbars even in the case where the connector has a structure that each terminal metal fitting is fastened to a busbar using a bolt.

It suffices that the "liquid-tight portion" have a stronger function of suppressing movement (entrance) of liquid from one housing room to (into) the other than in a case that such a liquid-tight portion is absent (i.e., the housing and the cover merely adjoin each other); the liquid-tight portion need not always have a function of preventing such movement of liquid completely. In other words, the above-mentioned projection and recess may be in close contact with each other, be opposed to each other with such a small gap that such movement of liquid can be suppressed, or be in close contact with each other in part of it and be opposed to each other with a small gap in the other part.

As illustrated in the above exemplary embodiments, the fastening target portion (7*a*) of one of the plurality of the busbars (7) and the fastening target portion (7*a*) of the another of the plurality of the busbars (7) may be arranged to be offset from each other when being viewed along a fastening axis direction of the bolt (61).

In the connector having the above configuration, the fastening target portions are arranged so as to be offset from each other when the fastening target portions (i.e., parts of the busbars) are viewed along the fastening axes of the bolts. Thus, when the fastening target portions are fastened actually using the bolts, one fastening target portion (or the bolt inserted in one fastening target portion) does not likely obstruct the work of fastening another fastening target portion using a bolt. As a result, in the connector having this configuration, the efficiency of work of fastening the busbars using the bolts can be increased.

As illustrated in the above exemplary embodiments, the cover (5) may have a guide portion (57) extending in an attaching direction for attaching the cover (5) to the housing (4), and the housing (4) may have a reception portion (43) extending in the attaching direction and receiving the guide portion (57).

In the connector having the above configuration, the efficiency of work of attaching the cover to the housing can be increased by the engagement between the guide portion (e.g., guide rib) of the cover and the reception portion (e.g., guide groove) of the housing. Furthermore, unintended lowering of the liquid-tightness providing function can be prevented because the projection and the recess are engaged with each other properly by suppressing the positional deviation between them.

As illustrated in the above exemplary embodiments, the housing (4) may have a nut setting portion (39) to place a nut (63) engaging with the bolt (61) and sandwiching the fastening target portion (7*a*) between the nut (63) and the bolt (61), and the nut setting portion (39) may be part of the partition wall (37, 52) having the liquid-tight portion (9).

In the connector having the above configuration, the partition wall having the liquid-tight portion is provided with the nut setting portion in which a nut to engage with a bolt with the fastening target portion sandwiched between the nut and the bolt can be set. Enabling unification of the nut setting portion and the partition wall, this measure allows the connector to be made smaller than in a case that the nut setting portion and the partition wall are provided separately.

The connectors according to the above exemplary embodiments enable to prevent unintended short-circuiting between busbars even in the case where the connectors have a structure that each terminal metal fitting is fastened to a busbar using a bolt.

What is claimed is:

1. A connector comprising:

a plurality of busbars;

a housing holding the plurality of the busbars; and a cover mounted on the housing, the plurality of the busbars each having a fastening target portion to connect a terminal metal fitting by using a bolt, the fastening target portion being housed in a housing room, and a plurality of the housing rooms being defined between the housing and the cover, one of the plurality of the housing rooms corresponding to the fastening target portion of one of the plurality of the busbars and another of the plurality of the housing rooms corresponding to the fastening target portion of another of the plurality of the busbars being separated with a partition wall, and at least part of the partition wall having a liquid-tight portion formed by inserting a projection of one of the housing and the cover into a cavity of other of the housing and the cover, wherein the housing has a nut setting portion to place a nut engaging with the bolt and sandwiching the fastening target portion between the nut and the bolt, and the nut setting portion is part of the partition wall having the liquid-tight portion.

2. The connector according to claim 1, wherein the fastening target portion of one of the plurality of the busbars and the fastening target portion of the another of the plurality of the busbars are arranged to be offset from each other upon being viewed along a fastening axis direction of the bolt.

3. The connector according to claim 1, wherein the cover has a guide portion extending in an attaching direction for attaching the cover to the housing, and the housing has a reception portion extending in the attaching direction and receiving the guide portion.

4. The connector according to claim 1, wherein the liquid-tight portion is formed by inserting the projection of the one of the housing and the cover into the cavity of the other of the housing and the cover in a direction that is parallel to a plane on which the fastening target portion connects the terminal metal fitting by using the bolt.

* * * * *